US009136659B2

(12) United States Patent
Fishman et al.

(10) Patent No.: US 9,136,659 B2
(45) Date of Patent: Sep. 15, 2015

(54) DOWNWARD COMPATIBLE VOLTAGE TRACK LIGHTING SYSTEM

(75) Inventors: Julia Fishman, Cranston, RI (US); James E. Kuchar, Fall River, MA (US); Alejandro Mier-Langner, Providence, RI (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 914 days.

(21) Appl. No.: 12/638,188

(22) Filed: Dec. 15, 2009

(65) Prior Publication Data

US 2011/0141749 A1 Jun. 16, 2011

(51) Int. Cl.

| | |
|---|---|
| ***F21S 8/00*** | (2006.01) |
| ***H01R 29/00*** | (2006.01) |
| *F21V 21/35* | (2006.01) |
| *H01R 25/14* | (2006.01) |

(52) U.S. Cl.
CPC ..... *H01R 29/00* (2013.01); *F21V 21/35* (2013.01); *H01R 25/145* (2013.01)

(58) Field of Classification Search
USPC ..... 362/419, 421, 427, 404, 249.11, 362/249.01, 219, 221, 225, 217.08, 362/217.15–217.17; 439/110–115, 439/209–211, 213
See application file for complete search history.

(56) References Cited

U.S. PATENT DOCUMENTS

| | | | | |
|---|---|---|---|---|
| 3,718,816 | A * | 2/1973 | Seelbach et al. | 362/394 |
| 3,836,936 | A * | 9/1974 | Clement | 439/115 |
| 4,655,520 | A * | 4/1987 | Cummings | 439/111 |
| 4,691,267 | A * | 9/1987 | Giesberg | 362/218 |
| 6,170,967 | B1 * | 1/2001 | Usher et al. | 362/394 |
| 6,220,721 | B1 * | 4/2001 | Chan et al. | 362/219 |
| 6,588,920 | B2 * | 7/2003 | Agro | 362/287 |
| 6,843,581 | B2 * | 1/2005 | Mier-Langner et al. | 362/220 |
| 2005/0152132 | A1 * | 7/2005 | Bernhart et al. | 362/147 |
| 2006/0039168 | A1 * | 2/2006 | Mier-Langner et al. | 362/648 |
| 2007/0153550 | A1 * | 7/2007 | Lehman et al. | 362/648 |

* cited by examiner

*Primary Examiner* — Jong-Suk (James) Lee
*Assistant Examiner* — Leah S Macchiarolo

(57) ABSTRACT

A multi-voltage compatible track system which has a single adapter for both 120 Volts and 277 Volts track systems. The systems further comprise a variable input voltage ballast capable of operating with both 120V and 277V input while operating properly.

20 Claims, 9 Drawing Sheets

DOWNWARD COMPATIBLE VOLTAGE TRACK LIGHTING SYSTEM

CROSS-REFERENCE TO RELATED DOCUMENTS

None

TECHNICAL FIELD

This present invention is related to track lighting. More specifically, the present invention is related to a track lighting system utilizing an adapter which is operable with both 120 Volts and 277 Volts track assemblies.

BACKGROUND

227 Volts adapters for track lighting systems are typically designed specifically for 277 Volts tracks. Similarly, 120 Volts adapters are typically designed for 120 Volts tracks. The 120 Volts adapters are designed with features, called rejection tabs, which prevent the 120 Volts luminaire from being energized on a 277 Volts track system.

This safety feature requires, however, that a track adapter be designed for each of 120 Volts and 277 Volts track lighting systems. In addition to the track adapter, the luminaire fixtures must also be designed for each of the 120 Volts and 277 Volts track assemblies. These factors both complicate product lines, manufacturing and increase costs.

It would be desirable to overcome these and other deficiencies and utilize a single track head adapter which may be utilized with luminaires with both 120 Volts and 277 Volts track assemblies. It would also be desirable to provide a track head adapter to utilize with prior art 120 Volts track assemblies but wherein the track system does not allow a prior art 120 Volts track head adapter to be energized on a 277 Volts track system.

SUMMARY

A downward voltage compatible track lighting system comprises a variable input voltage ballast in electrical communication with a track head adapter, the track head adapter having a contact holder, a first electrical contact extending from the contact holder and a second electrical contact extending from the contact holder, at least one of the first and second electrical contacts extending from the contact holder a first distance $R_1$, a track having an opening for receiving a track liner, the track liner disposed within the opening of the track, the track liner having at least a first upper cavity and at least a second lower cavity corresponding to the first electrical contact and the second electrical contact respectively, a sidewall extending between the first upper cavity and the second upper cavity, the sidewall disposed at a second distance $R_2$ from the contact holder, wherein the second distance $R_2$ is less than the first distance $R_1$. The downward voltage compatible track lighting system wherein the track head adapter is usable with both 120 Volts and 277 Volts track liners. The downward voltage compatible track lighting system further comprising a housing for storage of the ballast. The downward voltage compatible track lighting system further comprising a spacer disposed on the ballast. The downward voltage compatible track lighting system wherein the spacer positions the ballast against a surface of the housing wherein the housing functions as a heat sink for the ballast. The downward voltage compatible track lighting system further comprising a spacer on a ballast, the spacer positioning the ballast away from a light fixture connected to a ballast housing. The downward voltage compatible track lighting system further comprising a pin connected to the track head adapter, the contact holder being pivotable from a first position to a second position to one of engage or disengage the track liner.

A downward voltage compatible track lighting system comprises a track head adapter providing electrical communication between a track light fixture to an electrified track assembly, a variable voltage ballast in electrical communication with the track head adapter and the track light fixture, the track head adapter having a contact holder, a first electrical contact extending from the contact holder and a second electrical contact extending from the contact holder, a length defined between the first electrical contact and the second electrical contact, a track having an opening for receiving a track liner, the track liner receiving the track head adapter, the track liner having a first cavity corresponding to the first electrical contact and a second cavity corresponding to the second electrical contact, a sidewall extending between the first cavity and the second cavity, the sidewall being inset from ends of the first cavity and the second cavity toward the contact holder and inhibiting positioning of tabs on the contact holder between the electrical contacts due to interference with the sidewall. The downward voltage compatible track lighting system wherein the track head adapter is usable with track voltages of 120 Volts and 277 Volts. The downward voltage compatible track lighting system wherein the track head adapter being usable with a luminaire housing assembly. The downward voltage compatible track lighting system wherein the track head adapter is usable with a pendant light fixture. The downward voltage compatible track lighting system wherein the track head adapter has a loading bar. The downward voltage compatible track lighting system wherein the electrical contacts extending upwardly above the loading bar. The downward voltage compatible track lighting system further comprising a locking plate disposed above the loading bar, the locking plate engaging the track. The downward voltage compatible track lighting system further comprising an insulator post extending between the first electrical contact and said second electrical contact.

A downward voltage compatible track lighting system, comprises a track head adapter in electrical communication with an energized track assembly, a variable voltage ballast and a track lighting fixture, the track head adapter having an upper electrical contact and a lower electrical contact, the upper electrical contact spaced apart a distance from the lower electrical contact and defining a gap, the track assembly having a track and a track liner extending through an opening in the track, the track liner receiving the track head adapter, the track liner having a first cavity and a second cavity for receiving the first and second contacts, respectively, the first and second cavities defining a gap therebetween, an inner surface of a track liner sidewall disposed inwardly of an outermost point of at least one of the electrical contacts, the sidewall having a position which inhibits use of tabs on the contact holder disposed between the first cavity and the second cavity. The downward voltage compatible track lighting system wherein the track head adapter is compatible with either of 120 Volts and 277 Volts electrical sources. The downward voltage compatible track lighting system further comprising a pendant light fixture. The downward voltage compatible track lighting system further comprising a downlight fixture. The downward voltage compatible track lighting system further comprising a grounding clip which engages the track.

BRIEF DESCRIPTION OF THE ILLUSTRATIONS

Embodiments of the invention are illustrated in the following illustrations.

DETAILED DESCRIPTION

Figure 1:
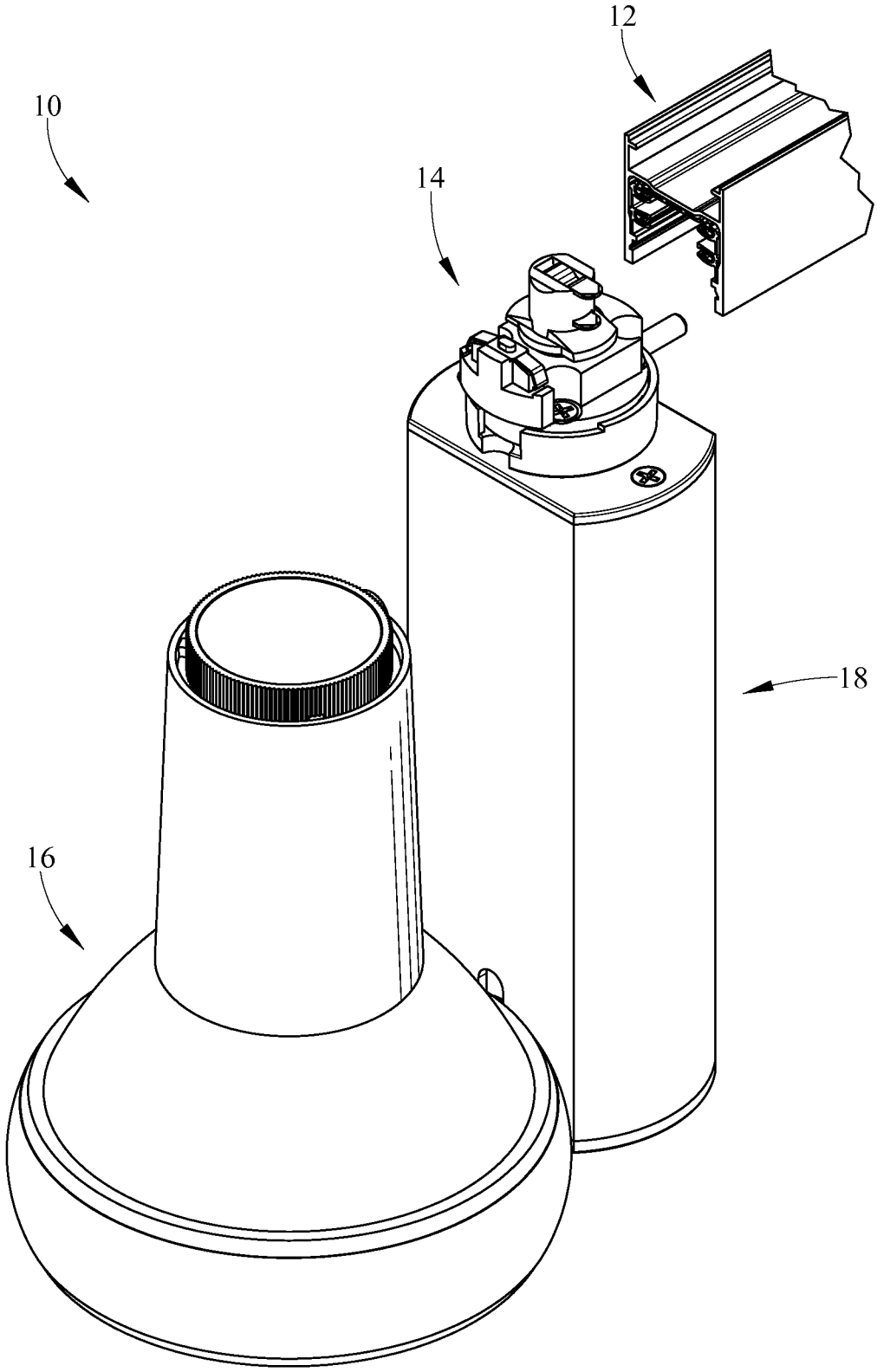
FIG. 1 is a perspective view of a track lighting system.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

A downward compatible voltage track lighting system is shown in the various FIGS. 1-11. The system utilizes a track head adapter which is usable with both 120 Volts and 277 Volts track assemblies in order to provide functionality between track assemblies and fixtures of either voltage. The track lighting system functions to allow use of a single track head adapter and a track assembly with either 120 Volts power source or 277 Volts power source. Accordingly, with such system, separate track head adapters are not needed for each of the different voltages which are commonly utilized in track lighting systems. However, the track head adapter allows backward compatibility with 120 Volts track assemblies while also inhibiting use of prior art 120 Volts track head adapters with 277 Volts track assemblies.

Referring initially to FIG. 1, a track lighting system 10 is depicting having a track assembly 12, a track head adapter 14 and at least one light fixture 16. The track lighting system 10 includes an upper track assembly 12 which is connected to a ceiling. A track head adapter 14 slides within the track assembly 12 and connects a ballast 60 (FIG. 2) and light fixture 16 to the electrified track assembly 12. Beneath the track head adapter 14 is a ballast housing 18 wherein the variable voltage ballast 60 (FIG. 2) is positioned and is in electrical communication with the track head adapter 14 and the track head assembly 12. A variable voltage ballast 60 (FIG. 2) receives input voltage of 120 Volts or 277 Volts from the track assembly and provides a suitable power a lamp within the light fixture 16. Various lamp types may be used based on lighting needs, fixture type, desired voltage and other factors as will be understood my one skilled in the art.

Figure 2:
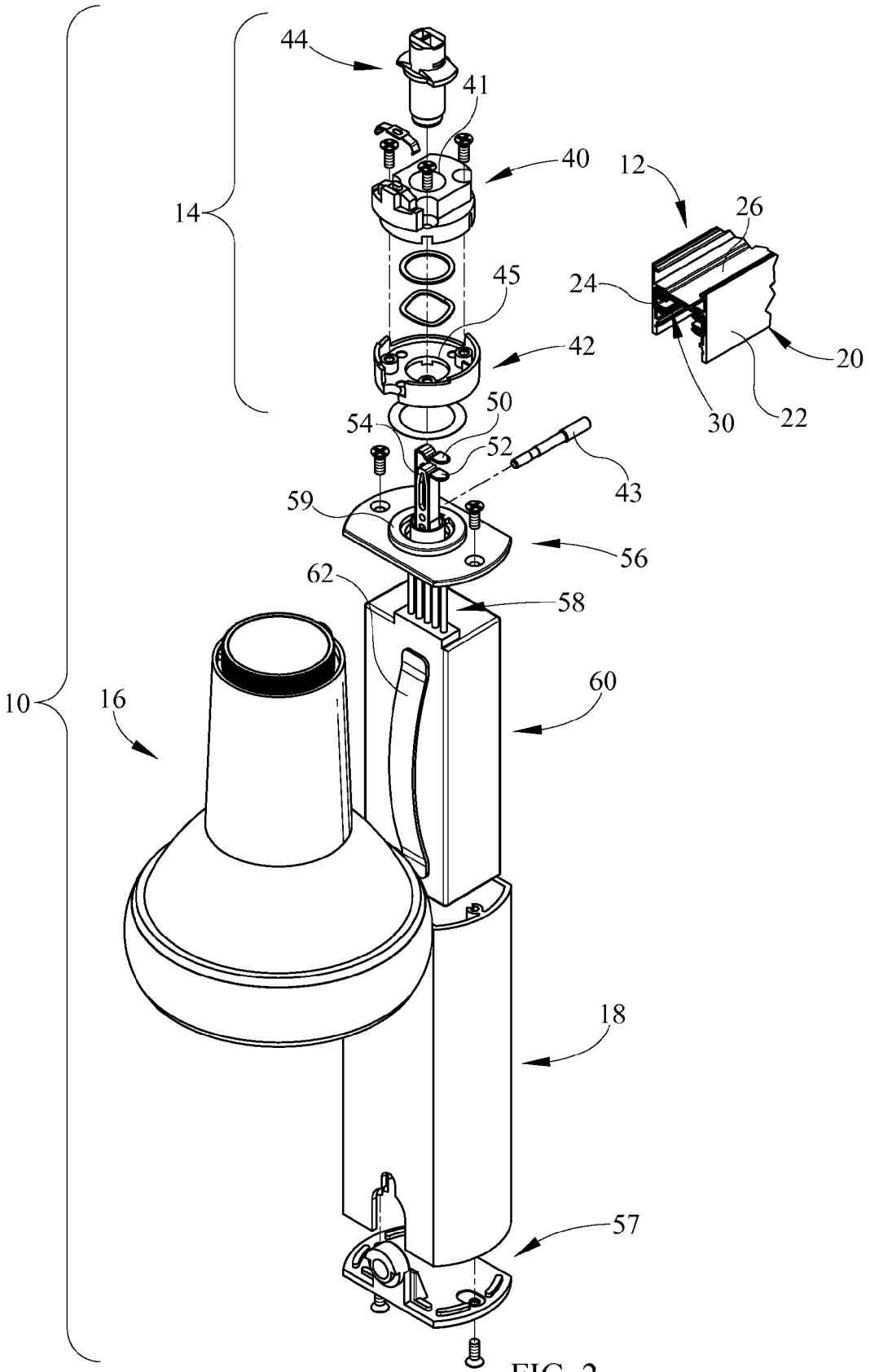
FIG. 2 is an exploded perspective view of the track lighting system of FIG. 1.

Referring now to FIG. 2, an exploded perspective view of the track lighting system 10 is depicted. The track assembly 12 includes a track or track portion 20 which is defined by first and second sidewalls 22, 24 and a cross-brace 26. The track 20 may be linear or curvilinear. The area above the cross-brace 26 receives a hanger assembly (not shown) for connection of the track assembly 12 to the ceiling. The lower area beneath the cross-brace 26 receives a liner 30, 130 (FIG. 5) which provides an electrical connection to the track head adapter 14. In turn, this provides the electrical communication between the ballast 60, and the power source which is electrically connected to the track assembly 12.

Adjacent the track assembly 12 is the track head adapter 14 comprising a housing adapter 40, a housing disc 42 and a contact holder 44. The housing adapter 40 is fastened to the housing disc 42 and connected to a ballast housing upper plate 56. The housing adapter 40 and housing disc 42 are generally circular in shape although not limited to such shape. Each have coaxial central apertures 41, 45 through which the contact holder 44 passes downwardly there through. The housing adapter 40 and the housing disc 42 are fixed relative to the housing upper plate 56 and a pin 43 is connected to the contact holder 44 allowing rotation of the contact holder 44 about a vertical axis relative to the housing adapter and housing disc 40, 42.

Beneath the track head adapter 14 are first and second contacts 50, 52. Disposed between the contacts 50, 52 is an insulator post 54 which inhibits touching of the contact 50 and the contact 52. According to the instant embodiment, one of the contacts 50, 52 may be a hot conductor and the other of the contacts 50, 52 may be a neutral conductor. The contacts 50, 52 are connected to wires which extend to and are in electrical communication with a ballast 60. A ground clip 48 (FIG. 3) is positioned on the track head adapter 14. The first and second contacts 50, 52 and the insulator post 54 extend upwardly through the housing plate 56, and more specifically through the central aperture 59 in the housing upper plate 56. The pin 43 is connected to the contact holder 44 wherein the first and second contacts 50, 52 are positioned. Pivoting of the pin 43 about a vertical axis therefore causes rotation of the contact holder 44 and the contacts 50, 52 to either engage or disengage a bus bar in the track liner 30.

Still referring to FIG. 2, beneath the upper plate 56 and electrically connected to the first and second contacts 50, 52 by a plurality of wires is the ballast 60. More specifically, the ballast 60 is a variable input voltage ballast which allows input power of 120 Volts as well as 277 Volts from the track assembly. Additional voltages may be utilized based on the type of ballast used with the embodiment. The ballast 60 includes a spacer 62 located on one surface of the outer structure. The spacer 62 is, according to the exemplary embodiment, a spring which forces or positions the ballast 60 away from the fixture 16 when the ballast 60 is positioned in the housing 18. This causes the ballast 60 to contact the housing 18 on a surface opposite the fixture 16, allowing the housing 18 to act as a heat sink for the ballast 60 and also spacing the ballast 60 away from the high temperature fixture 16. At the bottom portion of the housing 18 is a lower plate 57.

Connected to the lower plate by fastener is the fixture 16. The downlight fixture 16 of the exemplary embodiment is pivotable about a horizontal axis defined by the fastener so that the light output from the fixture 16 may be aimed to a desirable location within the room for illumination. However, as will be understood further, the track lighting assembly 10 may comprise multiple luminaire types.

Figure 3:
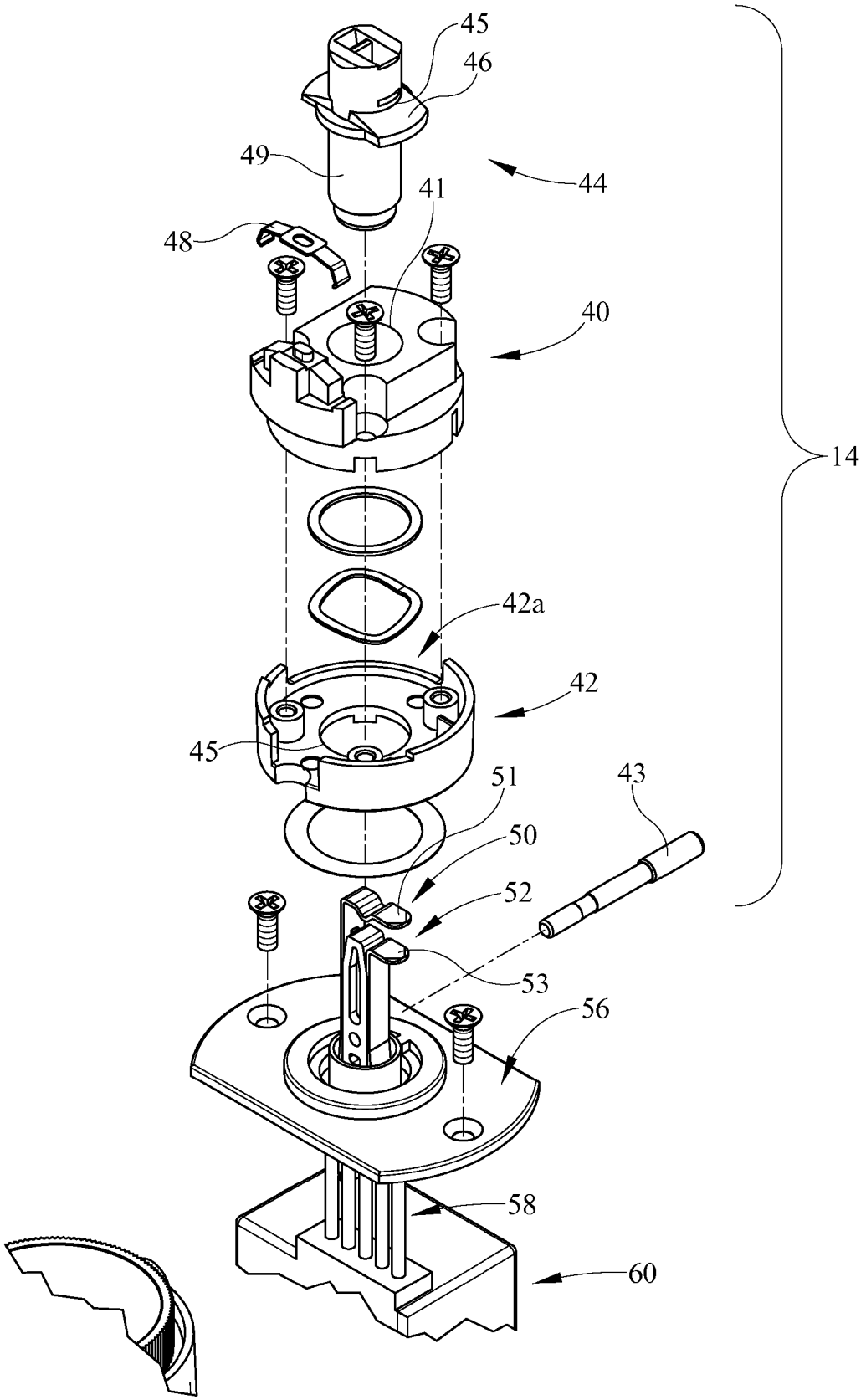
FIG. 3 is an exploded perspective view of the track head adapter of the track lighting system of FIG. 1.

Referring now to FIG. 3, an exploded perspective view of the track head adapter 14 is shown more closely. The housing adapter 40 is positioned above the housing disc 42. The housing disc 42 has a sidewall with a gap 42*a* through which the rotation pin 43 extends. Adjacent the housing adapter 40 is a ground clip 48 which provides a grounding conductor for the track head adapter 14 to the track assembly 12. The clip 48 has first and second ends which engage shoulders 28, 128 (FIGS. 4,5) on the track assembly 12. The housing adapter 40 is connected by three fasteners to the housing disc 42 so that the two structures are rigidly connected. The gap 42*a* and the housing disc therefore allows the pin 43 to pass between the housing disc 42 and housing adapter 40 as the pin 43 and contact holder 44 are rotated.

The contact holder 44 is shown disposed above the adapter 40. During installation, the contact holder 44 is positioned downwardly through the central opening 41, 45 in the housing adapter 40 and the housing disc 42 in order to place the lower portion 49 of the cylindrical contact holder 44 over the contacts 50, 52. More specifically, the upper portion of the contact holder 44 is opened so that end tab 51 of contact 50 extends through this upper aperture and outwardly there from. Contact holder 44 also includes an aperture 45 through which the tab 53 of contact 52 extends. The contact older 44 also includes arms 46 extending from the generally cylindrical contact body 49. The arms 46 are seated on shoulders within the track 20, as described further herein.

Figure 4:
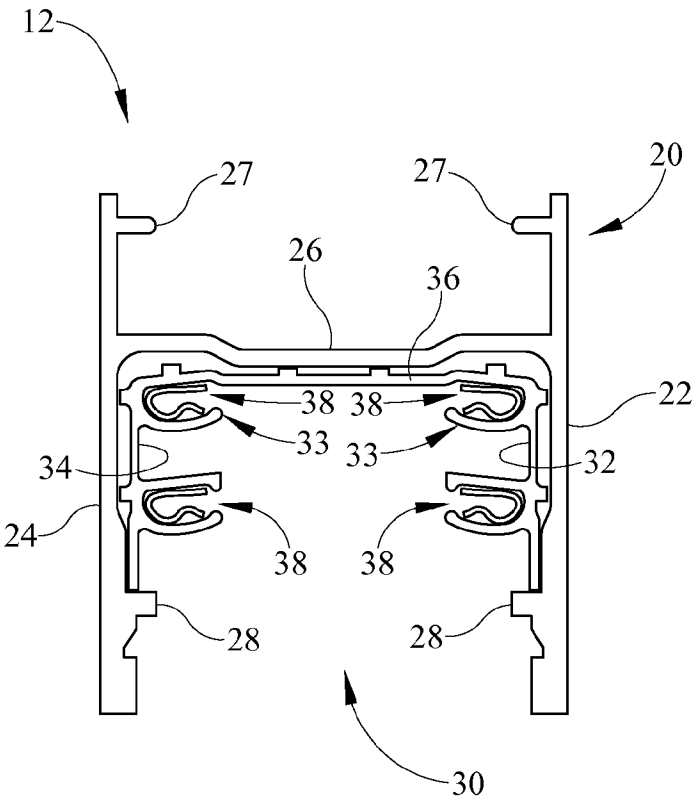
FIG. 4 is an end view of a track assembly having a track liner utilized with 120 Volts power source.

Referring now to FIG. 4, an end view of the track assembly 12 is depicted. As previously described, the track 20 includes a first wall 22 and a second wall 24 which are spaced apart by a cross-brace 26. Above the cross-brace 26 are upper shoulders extending inwardly from the sidewalls 22, 24. Beneath the cross-brace 26 are the lower shoulders 28 which also extend inwardly from the walls 22, 24. Disposed within the track 20, beneath the cross-brace 26 is a liner 30. The track liner 30 of FIG. 4 is designed for use with 120 Volts power source. The liner 30 includes first and second sidewalls 32, 34 as well as a top wall 36. The liner 30 also includes upper cavities 33 and lower cavities 35 wherein bus bars 38 are positioned. The bus bars 38 are electrically conductive and are in electrical communication with a power supply (not shown) which electrifies the track assembly 12. As a result, when the contacts 50, 52, and more specifically the contact tabs 51, 53, are positioned within the bus bars 38 of the upper and lower cavities 33, 35, the power source of the track assembly 12 is then in electrical communication with the track head adapter 14 and ballast 60 and light fixture 16. Alternatively, when the pin 43 is rotated to disengage the tabs 51, 53 from the bus bars 38, the power supply is no longer in electrical communication with the ballast 60 and fixture 16.

Figure 5:
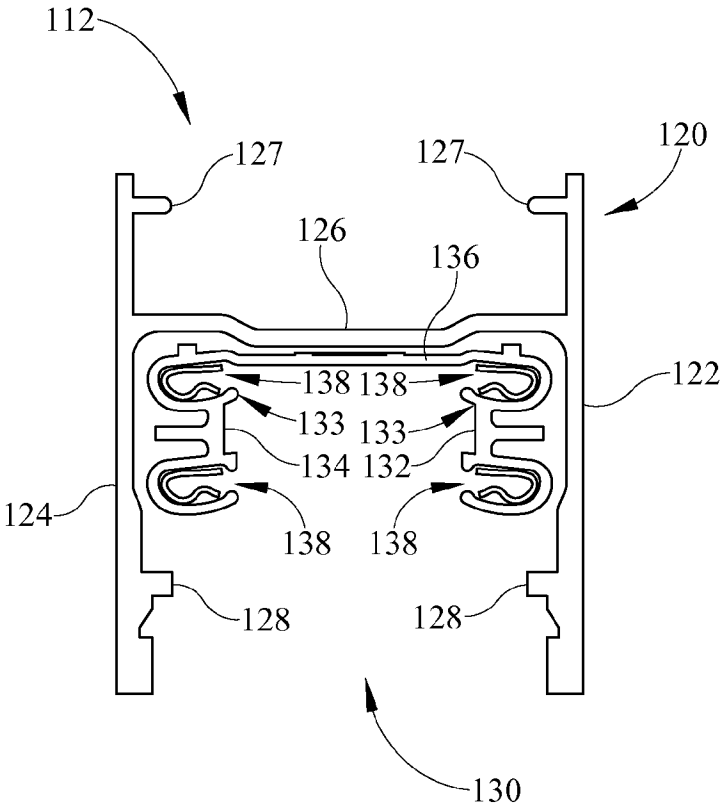
FIG. 5 is an end view of a track assembly having a track liner utilized with 277 Volts powers source.

Referring now to FIG. 5, an end view of an alternate track assembly 112 is depicted. The track assembly 112 is a 277 Volts track assembly. The track structure 112 is the same as that of track 12 and will not be described again. However, the liner 130 differs in that the sidewalls 132, 134 are spaced inwardly from the positions shown and discussed with the 120 Volts liner 30. Prior art 120 Volts adapters include rejection tabs extending radially outward from the track head adapters. The closely spaced nature of walls 132, 134 as opposed to walls 32, 34 inhibit use of those adapters with the closely spaced sidewalls 132, 134. However, the closely spaced sidewalls 132, 134 inhibit positioning of these track heads with rejection tabs therein inhibiting rotation of the contacts into the bus bars of upper and lower cavities. In short, this inhibits use of an older-type 120 Volts adapter with 277 Volts track assembly.

Figure 6:
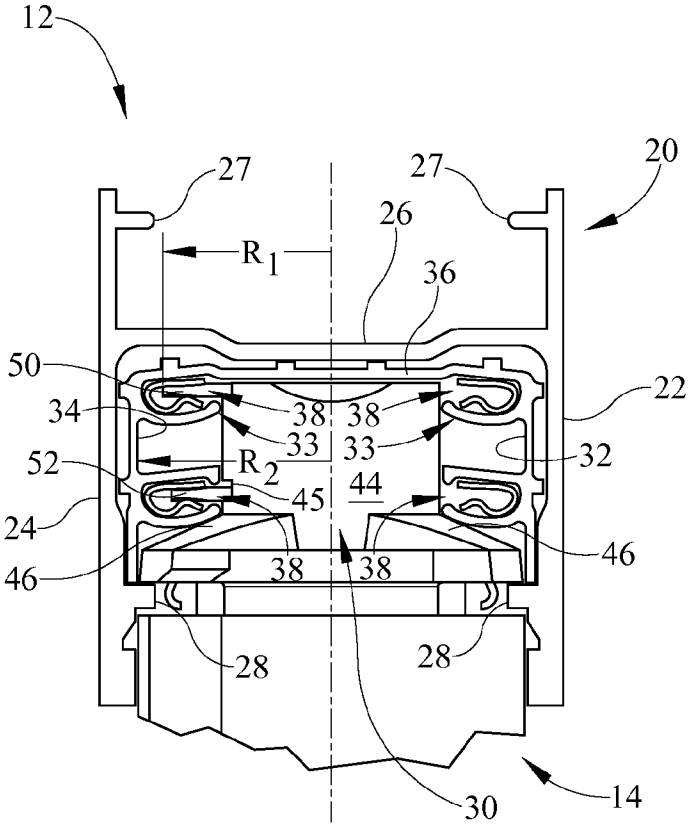
FIG. 6 is an end view of a track lighting system having the track assembly of FIG. 4 and a track head adapter for use with 120 Volts or 277 Volts track assemblies.

Referring now to FIG. 6, an end view of the track head adapter 14 and track assembly 12 is shown with the adapter 14 disposed therein. The embodiment depicts a track liner which is for use with 120 Volts tracks. The track head adapter 14 is usable with these older 120 Volts track assemblies as well as 277 Volts. However, prior art 120 Volts adapters having rejection tabs are not usable with the track liner 130. The electrical contacts 50, 52 are positioned within the bus bars 38 of the upper and lower cavities 33, 35. In this position, the electrified track assembly 12 is in electrical communication with the ballast 60 and the connected light fixture 16. Extending from the contact holder 44, the arms 46 are shown seated on the lower shoulders 28 of the track 20.

Figure 7:
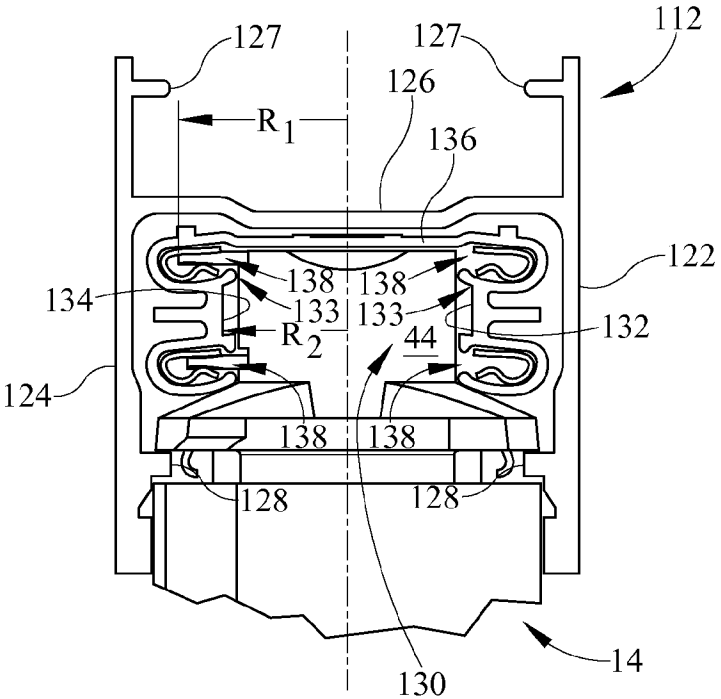
FIG. 7 is an end view of the track lighting system having the track assembly of FIG. 5 and a track head adapter for use with 120 Volts or 277 Volts track assemblies.

Referring now to FIG. 7, the track head 14 is depicted as positioned within the track assembly 112 and engaging the bus bars 138 in the upper and lower cavities 133, 135 of the track liner 130. The track liner 130 is usable with the track head adapter 14 but inhibits use with prior art 120 Volts adapters. However, the adapter 14 of the system may be utilized with prior art 120 Volts track liner, rendering the system backward compatible while inhibiting use of prior art 120 Volts luminaire in a 277 Volts track.

In comparing FIG. 6 and FIG. 7, the track liner of FIG. 7 has a distance $R_2$ indicated from a centerline of the track head. The distance $R_2$ is less than the distance $R_1$, which measures the tip of the electrical contact 50 to a centerline of the track head adapter 14. Alternatively stated, the liner sidewall 132, 134 of the 277 Volts track assembly 112 are inset from the outer edges of the track liner which are defined by the cavities 133, 135. Since the sidewalls 132, 134 are inset and closely spaced to the upper portion of the contact holder 44, a track head adapter having rejection tabs, such as those known in prior art, for use in 120 Volts systems may not be utilized with the track liner 130. However, the track head adapter 14 may be used with 120 Volts track assembly 12 as shown in FIG. 6 with the use of universal or variable input voltage ballast 60. In short, the track head adapter 14 may be used with prior art track liners, however, prior art 120 Volts track head adapter cannot necessarily be used with the track liner 130.

Figure 8:
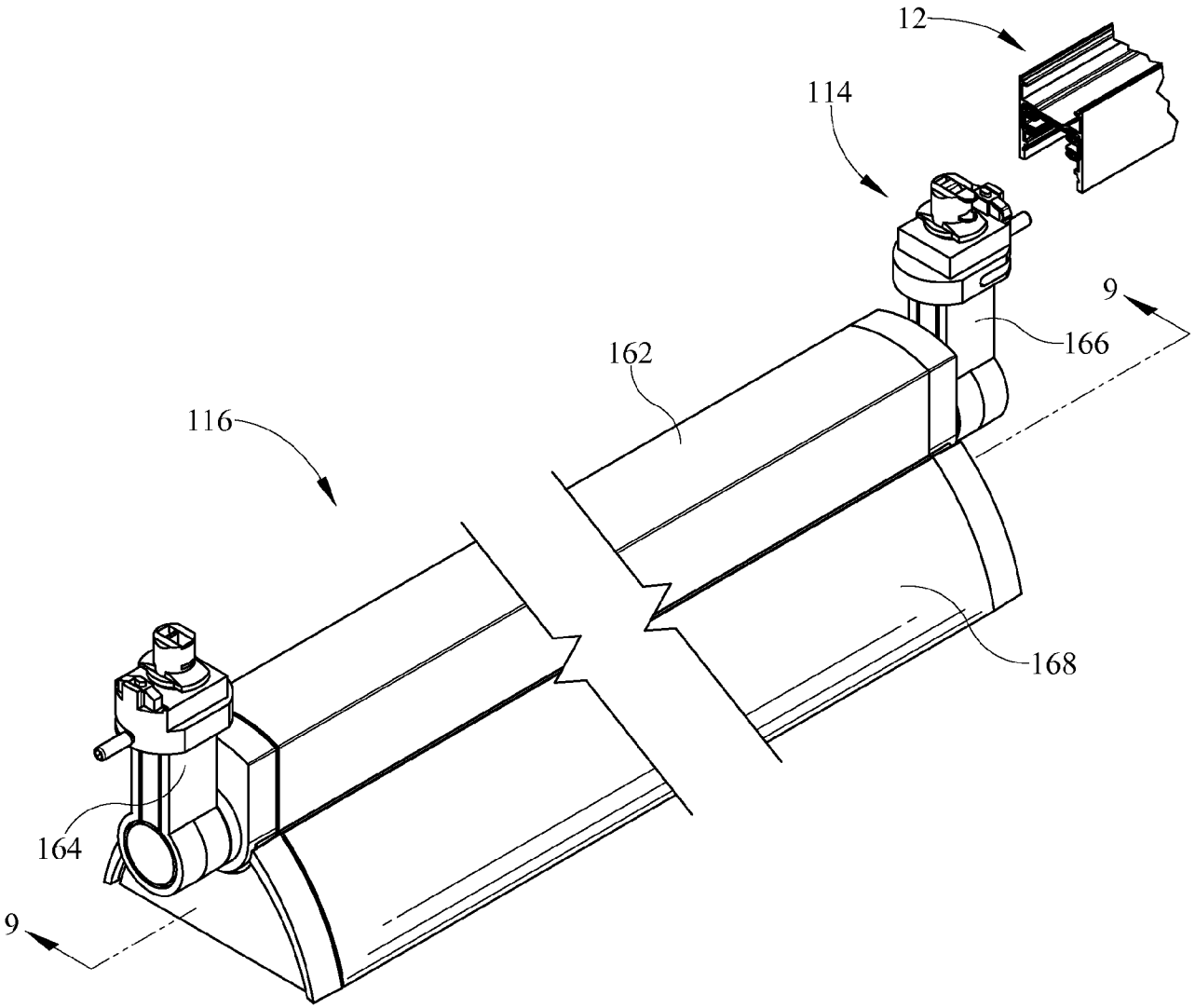
FIG. 8 is a perspective view of a troffer fixture which may be used.
Figure 9:
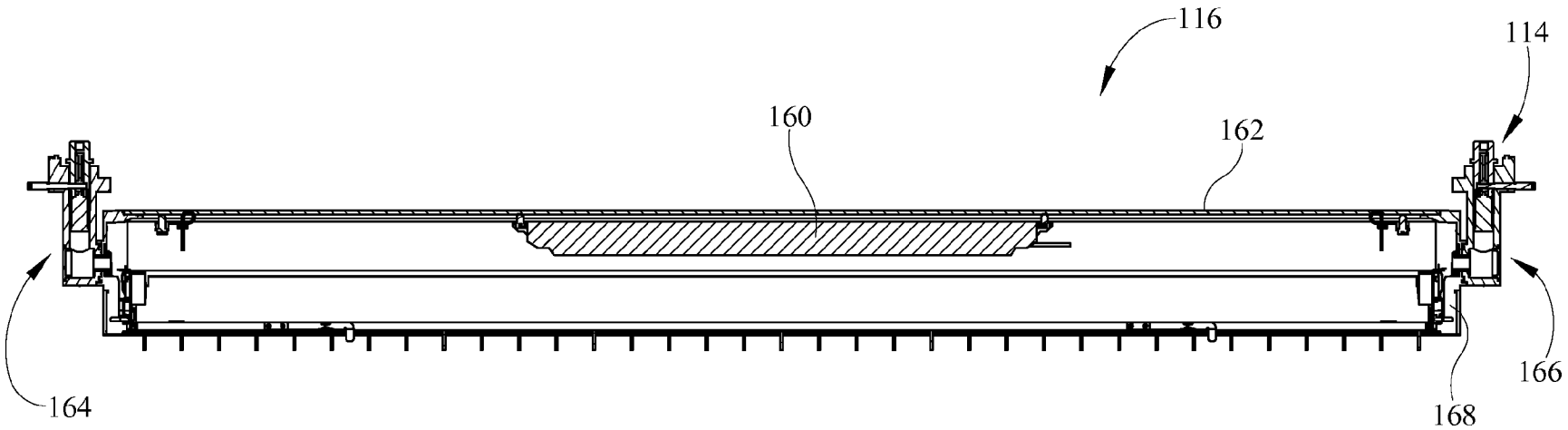
FIG. 9 is a section view of the troffer of FIG. 8.
Figure 10:
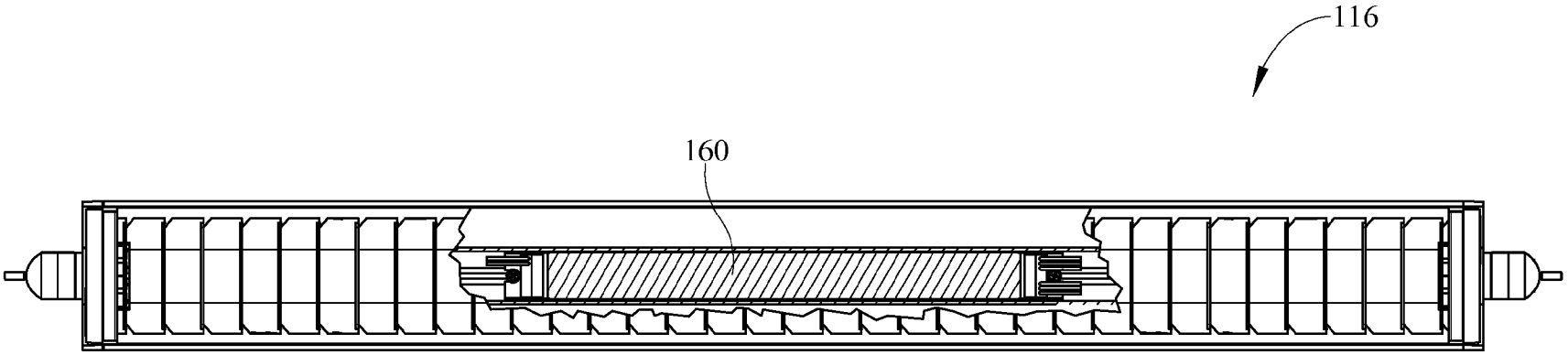
FIG. 10 is a bottom view of the troffer fixture of FIG. 8.

Referring now to FIGS. 8-10, an alternative embodiment of a light fixture is shown being utilized with the track head adapter form 114. The fixture 116 is a troffer fixture, rather than the downlight type fixture previously shown. The troffer fixture 116 includes an upper housing 162 extending between and pivotally connected to first and second arms 164, 166. The upper portion of one of the arms 164, 166 includes the upper track head adapter 114 which engages the track 12, 112. As previously described, the instant track head adapter 114 may be utilized with either track assembly 12, 112 as previously described. This allows the troffer fixture 116 to be utilized on 120 Volts track assemblies or 277 Volts track assemblies. Disposed within the housing 162 is a variable input voltage ballast 160 (FIG. 9). The ballast regulates the voltage from the track assembly 12, 112 also allowing use of the track fixture 116 with different voltages.

Depending from the housing 162 is a reflector 168. The reflector 168 is generally parabolic in shape and may be directionally adjusted by utilizing the pivotal connection between the arms 164, 166 and the housing 162. The troffer fixture 116 therefore may be positioned in a track assembly 12, 112 and moved along the track assembly to a desirable position.

Figure 11:
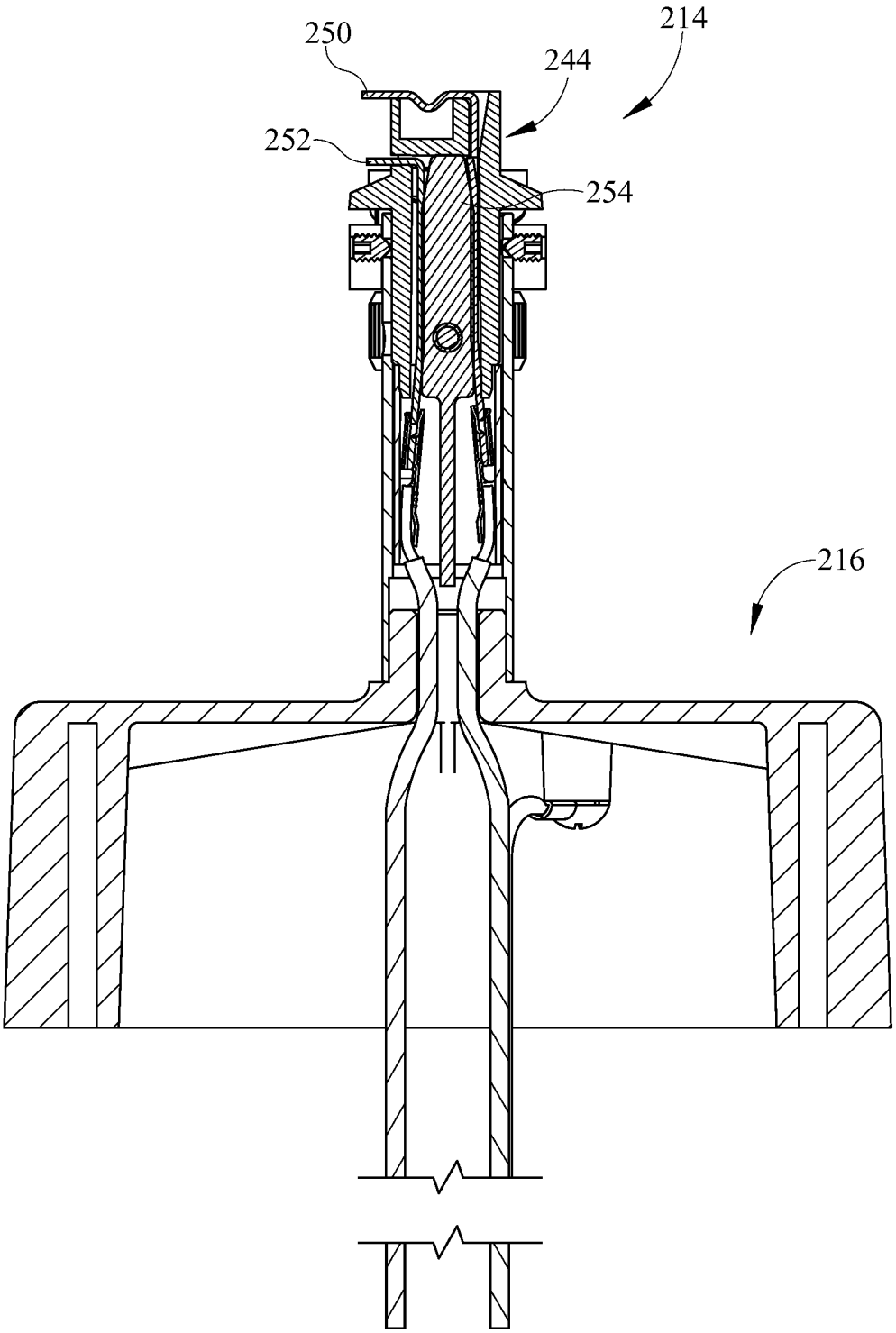
FIG. 11 is a side-section view of a pendant light track head adapter.

Referring now to FIG. 11, a cross-section view of an alternate track head adapter 214 is depicted for use with a pendant light fixture. The track head adapter 214 includes first and second contacts 250, 252 as well as an insulator post 254. Wiring connections pass downwardly through a cap structure 218 and extend downwardly to a ballast (not shown) and a fixture (not shown). The track head adapter 214 in combination with the variable input voltage ballast allows use of the fixture of this embodiment with track assemblies having differing voltages.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A downward voltage compatible track lighting system, comprising:

a ballast usable with at least first and second different voltages and having two electrical contacts extending a first distance from a centerline;

a track head adapter having a contact holder for receiving the two electrical contacts and selectively including a rejection tab for the ballast usable with the first voltage; and a track liner for receiving the track head adapter and having at least a pair of upper and lower cavities corresponding to said two electrical contacts respectively and separated by a sidewall extending between said upper and lower cavities a second distance from said centerline, the second distance is selected from one sufficient for the sidewall to enable and to prevent receipt in the track liner of the ballast having the rejection tab.

2. The system of claim 1, wherein said two different voltages are selected from 120 Volts and 277 Volts.

3. The system of claim 1, further comprising a housing for said ballast and a track for receiving the track liner.

4. The system of claim 3, further comprising a spacer for said ballast.

5. The system of claim 4, wherein said spacer is configured to position said ballast against a surface of said housing, said housing functions as a heat sink for said ballast.

6. The system of claim 3, further comprising a spacer for the ballast and a light fixture connected to the ballast, said spacer is configured to position said ballast away from the housing.

7. The system of claim 1, further comprising a pin connected to said track head adapter, said contact holder is pivotable from a first position to a second position to engage or disengage said track liner.

8. A downward voltage compatible track lighting system, comprising:

a ballast in electrical communication with said track head adapter, the ballast usable with at least two different voltages and having;

a track head adapter having a contact holder electrically coupled to a fixture powered by one of at least first and second different voltages and selectively including a rejection tab for indicating that the ballast is usable only with the first voltage, the two electrical contacts extending a first distance from a centerline of the track head adapter in the contact holder; and a track liner for receiving the track head adapter and having a first cavity corresponding to said first electrical contact and a second cavity corresponding to said second electrical contact and separated by a sidewall extending between said first cavity and said second cavity, the location of the sidewall is selected from one of enabling and inhibiting coupling to the track liner of the fixture-powered by the voltage associate with the rejection tab.

9. The system of claim 8, wherein said at least two different voltages are selected from 120 Volts and 277 Volts.

10. The system of claim 9, wherein said track head adapter is configured for use with a luminaire housing assembly.

11. The system of claim 9, wherein said track head adapter is configured for use with a pendant light fixture.

12. The system of claim 11, wherein said track head adapter includes arms for selectively coupling with the track liner powered by the voltage selected for the fixture.

13. The system of claim 12, wherein said electrical contacts extend upwardly above said arms.

14. The system of claim 12, further comprising a housing for said track head adapter and a track for receiving the track liner.

15. The system of claim 8, further comprising an insulator post extending between said first and second electrical contacts.

16. The system of claim 15, further comprising a grounding clip for engaging said track liner.

17. A downward voltage compatible track lighting system, comprising:

a ballast usable with at least first and second different voltages and having upper and lower electrical contacts;

a track head adapter for coupling to a fixture powered by the first voltage and having rejection tabs indicating the first voltage, the upper and lower electrical contacts spaced a first distance apart and defining a gap in the track head adapter;

a track liner for receiving the track head adapter and having first and second cavities for receiving said first and second electrical contacts, respectively, said first and second cavities defining a gap therebetween, and a sidewall disposed inwardly of an outermost point of at least one of said first and second electrical contacts, said sidewall having a position selected from one of enabling and inhibiting positioning of the rejection tabs between said first and second cavities.

18. The system of claim 17, wherein said at least two different voltages are selected from 120 Volts and 277 Volts electrical sources.

19. The system of claim 17, wherein the fixture is a pendant light fixture.

20. The system of claim 17, wherein the fixture is a downlight fixture.

* * * * *